US011819135B2

(12) United States Patent
Kardeh et al.

(10) Patent No.: US 11,819,135 B2
(45) Date of Patent: Nov. 21, 2023

(54) FOAM CORE FOR A MATTRESS AND MATTRESS

(71) Applicant: Emma Sleep GmbH, Frankfurt am Main (DE)

(72) Inventors: Majid Kardeh, Frankfurt am Main (DE); Jeong-Hun Yi, Frankfurt am Main (DE)

(73) Assignee: EMMA SLEEP GMBH

( * ) Notice: Subject to any disclaimer, the term of this patent is extended or adjusted under 35 U.S.C. 154(b) by 61 days.

(21) Appl. No.: 17/389,165

(22) Filed: Jul. 29, 2021

(65) Prior Publication Data

US 2022/0031086 A1 Feb. 3, 2022

(30) Foreign Application Priority Data

Jul. 30, 2020 (DE) ..... 10 2020 120 186.9

(51) Int. Cl.
*A47C 27/15* (2006.01)
*A47C 27/14* (2006.01)

(52) U.S. Cl.
CPC ..... *A47C 27/15* (2013.01); *A47C 27/144* (2013.01); *A47C 27/146* (2013.01)

(58) Field of Classification Search
CPC ..... A47C 27/15; A47C 27/144; A47C 27/146; A47C 27/148; A47C 27/067; A47C 27/064
See application file for complete search history.

(56) References Cited

U.S. PATENT DOCUMENTS 5,533,218 A * 7/1996 Fahy ..... A47C 27/16 5/636
5,604,021 A * 2/1997 Wagner ..... A47C 27/148 428/167
5,671,492 A 9/1997 Simon
6,041,459 A * 3/2000 Nunez ..... A47C 27/148 5/730
9,259,099 B1 * 2/2016 Larsen ..... A47C 27/148
(Continued)

FOREIGN PATENT DOCUMENTS

DE 20102701 U1 5/2001
DE 10359862 B4 8/2004
(Continued)

*Primary Examiner* — Justin C Mikowski
*Assistant Examiner* — Alison N Labarge
(74) *Attorney, Agent, or Firm* — Dilworth IP, LLC

(57) ABSTRACT

A foam core for a mattress including a supporting layer for supporting the vertebral column, the supporting layer including an upper part and a lower part. Different body support regions are provided in the upper part along the longitudinal direction of the foam core, a plurality of the body support regions having at least one recess in the material of the foam core. At least one reserve region is provided in the lower part and has at least one recess in the material of the foam core. The foam core is formed such that the reserve region is not substantially deformed in case of a load on the upper part above the reserve region if the load is below a predetermined limit pressure, and that in case of a load above the predetermined limit pressure, the reserve region is deformed. A mattress having such a foam core is furthermore shown.

20 Claims, 3 Drawing Sheets

(56) References Cited

U.S. PATENT DOCUMENTS

| | | | | |
|---|---|---|---|---|
| 2005/0193497 | A1* | 9/2005 | Baker | A47C 27/001 5/721 |
| 2005/0210595 | A1* | 9/2005 | Di Stasio | A47C 21/046 5/690 |
| 2010/0227091 | A1 | 9/2010 | Pearce | |
| 2012/0260420 | A1* | 10/2012 | Piraino | A47C 23/067 703/2 |
| 2017/0156506 | A1* | 6/2017 | Torbet | A47C 27/15 |
| 2019/0274443 | A1* | 9/2019 | Chan | A47C 27/144 |

FOREIGN PATENT DOCUMENTS

| | | | |
|---|---|---|---|
| DE | 202007012473 | U1 | 1/2008 |
| DE | 202009008359 | U1 | 8/2009 |
| DE | 102010038110 | A1 | 4/2012 |
| DE | 202018103007 | U1 | 6/2018 |
| DE | 202019105682 | U1 | 10/2019 |
| DE | 102018219363 | A1 | 4/2020 |
| EP | 3698675 | A1 | 8/2020 |
| NL | 2021803 | B1 | 5/2020 |

* cited by examiner

FOAM CORE FOR A MATTRESS AND MATTRESS

FIELD OF THE DISCLOSURE

Embodiments of the present disclosure relate to a foam core for a mattress and to a mattress.

BACKGROUND

A mattress suitable for the respective individual is necessary for a restful and healthy sleep. Here, both the different sleeping types (side sleeper, back sleeper, belly sleeper) and the different body build types of individuals are to be taken into account.

Usually, individuals are classified into different body build types to estimate the weight distribution of the individual along the body thereof. Here, the types H, E, I, A are usually used, as explained, for example, in issue April 2016, page 68 of Stiftung Warentest.

Body build type H corresponds to a tall person, for example a man having a predominant weight at the stomach, type E corresponds to a tall person, for example a man having a balanced weight distribution between the shoulders and the stomach, type I to a light person, for example a woman having a balanced weight distribution, and type A to a smaller person, for example a women having most of the weight in the hip area.

Usually, foam mattresses are adapted to one sleep type and one body build type to ensure the optimum support of the vertebral column during sleep. Under circumstances, compromises are made as to the support of the vertebral column to be able to provide mattresses for one sleep type but two similar body types, for example A and I, or E and H.

Despite everything, this result in the need to develop and manufacture many different types of mattresses and mattress cores to be able to offer a suitable mattress for any combinations of sleep types and body build types. The manufacture of mattresses and mattress cores is therefore expensive.

SUMMARY

It is thus the object to provide a foam core and a mattress which is optimized for many combinations of sleep types and body build types.

The object is achieved by a foam core for a mattress, comprising a supporting layer for supporting the vertebral column, the supporting layer including an upper part and a lower part. Different body support regions are provided in the upper part along the longitudinal direction of the foam core, a plurality of the body support regions having at least one recess in the material of the foam core. At least one reserve region is provided in the lower part along the longitudinal direction of the foam core and has at least one recess in the material of the foam core. The foam core is formed such that the reserve region is not substantially deformed in case of a load on the upper part above the reserve region if the load is below a predetermined limit pressure, and that in case of a load above the predetermined limit pressure, the reserve region is deformed.

Due to the fact that the reserve region is deformed only above a limit pressure, but does not have any effect in the other cases, it is possible to optimally adapt the section of the reserve region to all body types such that this section of the mattress optimally supports different body types. It is thus possible to adapt the foam core both to different, in particular to all body build types and also to take back sleepers and side sleepers into account by a rotation about an upward axis. A broad customer base can thus be addressed using a single foam core or a single mattress, as a result of which the numbers of pieces for this mattress can be increased. This results in economies of scale which make the manufacture more economical.

In the context of the present disclosure, "not substantially deformed" means that no change in the supporting effect of the foam core for the vertebral column, in particular of a side sleeper is present as compared to a foam core without any reserve region.

Specifications such as "top" and "bottom" and the longitudinal, transverse and upward directions are to be understood in relation to the intended position of use of the foam core.

The foam core may be formed in the lower part outside the reserve region as a solid material or without any recesses.

For example, the foam core has the same size as the intended lying surface, i.e. it has an outer periphery which corresponds to the intended lying surface.

The recesses may have an oval, circular, rectangular, trapezoidal, diamond-shaped profile or a combination thereof.

For example, all body support regions include at least one, in particular a plurality of recesses.

In one configuration of the present disclosure, the recesses run parallel to the transverse direction of the foam core and/or run over the entire width of the foam core, as a result of which the same lying properties are ensured over the width of the mattress.

For example, several, in particular all recesses in the upper part are grooves originating from the upper side of the foam core, in particular wherein the grooves partly have different depths in the upward direction. In this way, recesses can be reliably manufactured with small deviations from each other.

To optimally support different regions of the body of an individual, the different body support regions may have different strengths by using different and/or a different number of recesses, in particular wherein the outer body support regions in the longitudinal direction have a lower strength than the adjacent body support regions.

For example, the foam core has a center plane perpendicular to the longitudinal direction which subdivides the foam core into a first half and a second half.

In one configuration, the recesses of the upper part and/or of the lower part are asymmetrical with respect to the center plane, as a result of which the mattress is simultaneously suitable for different sleep types and/or body types.

The at least one reserve region may be exclusively provided in the first half in order that one half is suitable for different, greatly varying body types.

In one embodiment, the foam core is formed such that the first half as a head end and the second half as a foot end provide optimum support of the vertebral column for side sleepers, and the first half as a foot end and the second half as a head end provide optimum support of the vertebral column for back sleepers. The mattress or the foam core is thus suitable for different sleep types by a rotation about the upward axis thereof.

For example, a central body support region adjoining the center plane, an outer body support region adjoining the respective end in the longitudinal direction of the foam core, and a center body support region arranged between the central body support region and the outer body support region are provided in each of the halves, as a result of which an adaptation of the foam core to the different body regions (head/shoulder, lumbar spinal column, hip, knee, foot) is possible.

In particular, at least one of the outer body support regions extends over at least a quarter of the length of the foam core.

In one embodiment, the outer body support region respectively has a lower strength than the central body support region, the center body support region respectively has a higher strength than the outer body support region and the central body support region, and/or the central body support region of the first half has the same strength as the central body support region of the second half. In this way, the vertebral column of a side or back sleeper can be well supported.

The reserve region is for example provided below the outer body support region and/or below the center body support region of the first half to provide a reserve for the sinking to a head/shoulder region of an individual.

The reserve region may extend from one end of the foam core in the longitudinal direction, in particular further than a quarter of the length of the foam core, as a result of which the reserve for the sinking can be provided over a large region.

In one embodiment, the foam core has a comfort layer which is provided on the upper side of the supporting layer, in particular wherein the comfort layer is free from recesses. The comfort layer can further improve the lying comfort provided by the foam core.

The recesses of the body support regions and of the reserve region are in particular adapted to the influence that the comfort layer has.

The comfort layer and the supporting layer may be made of different materials, in particular from different foams. It is also conceivable that the comfort layer is made of a plurality of material layers or a plurality of layers.

The object is further achieved by a mattress having a previously described foam core.

The advantages and features of the foam core equally apply to the mattress and vice versa.

BRIEF DESCRIPTION OF THE DRAWINGS

Further features and advantages of the claimed subject matter will become apparent from the description below and from the accompanying drawings to which reference is made and in which:

DETAILED DESCRIPTION

Figure 1:
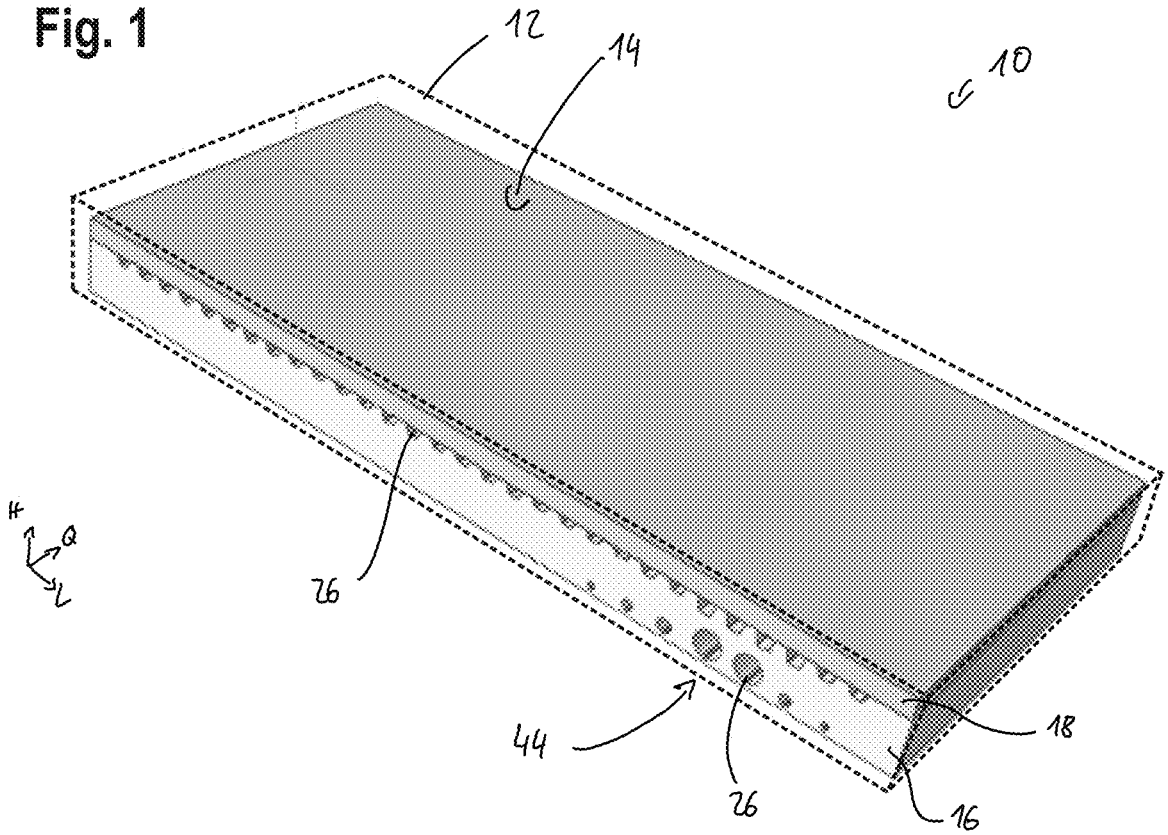
FIG. 1 shows a mattress according to the present disclosure having a foam core according to the present disclosure in a perspective view.

FIG. 1 shows a mattress 10 having a cover 12 (drawn in dashed lines) and a foam core 14.

The foam core 14 has two layers, namely a supporting layer 16 and a comfort layer 18.

In the intended position of use, the mattress 10 and thus the foam core 14 with the individual layers 16, 18 has a longitudinal direction L, a transverse direction Q, and an upward direction H.

The longitudinal direction L corresponds to the body direction of an individual in the intended lying position on the mattress.

The transverse direction Q is the horizontal direction perpendicular to the longitudinal direction L. The upward direction H corresponds to the vertical direction in the intended position of use.

According to the intended position of use, the layers 16, 18 each have a bottom side and an upper side.

Both the supporting layer 16 and the comfort layer 18 are as large as the desired lying surface, that is, their outer dimensions correspond to the outer dimensions of the desired lying surface.

The supporting layer 16 and the comfort layer 18 are made of different materials, for example different foams, and the comfort layer 18 is arranged on the upper side so as to be flush with the supporting layer 16 on all sides in the intended state of use.

The comfort layer 18 itself may in turn be made of several different layers or layers of material.

For example, the degree of hardness of the supporting layer 16 is 5.0 kPa±0.75 kPa, and the degree of hardness of the comfort layer 18 is 2.5 kPa±0.35 kPa.

The comfort layer 18 is made of a solid material, i.e. without any recesses or the like.

The bottom side of the comfort layer 18 rests on the upper side of the supporting layer 16. The two layers 16, 18 can be joined, for example glued together.

The height $h_1$ of the supporting layer 16 in the upward direction H is greater than the height $h_2$ of the comfort layer 18.

Figure 3:
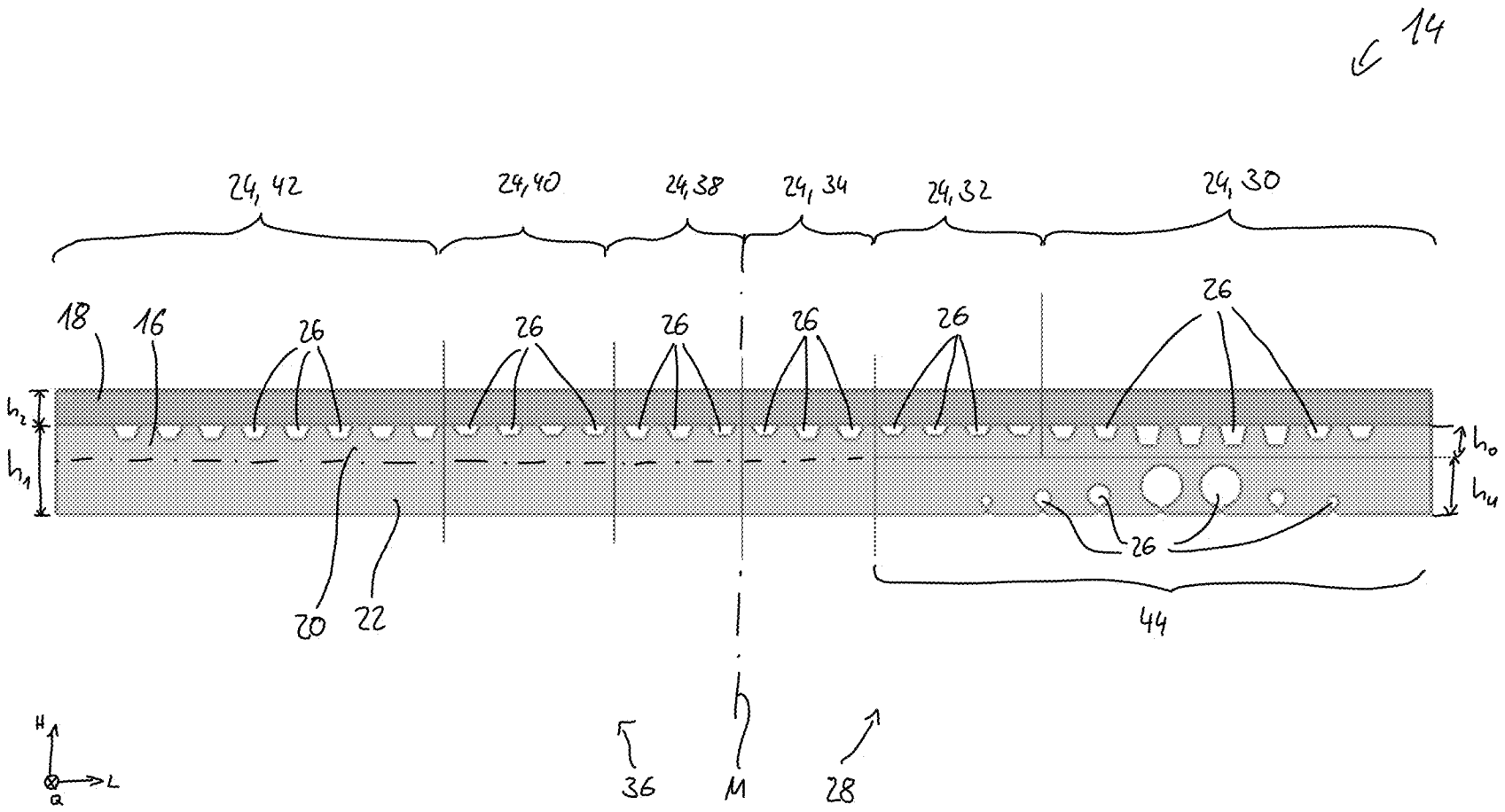
FIG. 3 shows a side view of the foam core according to FIG. 1.

Generally, the supporting layer 16 has an upper part 20 and a lower part 22, as can be seen in FIG. 3.

The upper part 20 and the lower part 22 are separated from each other by a horizontal plane.

In this case, the height $h_u$ of the lower part 22 is at least half the height $h_1$ of the supporting layer 16, or the height $h_u$ is greater than the height $h_o$ of the upper part 20.

Figure 2:
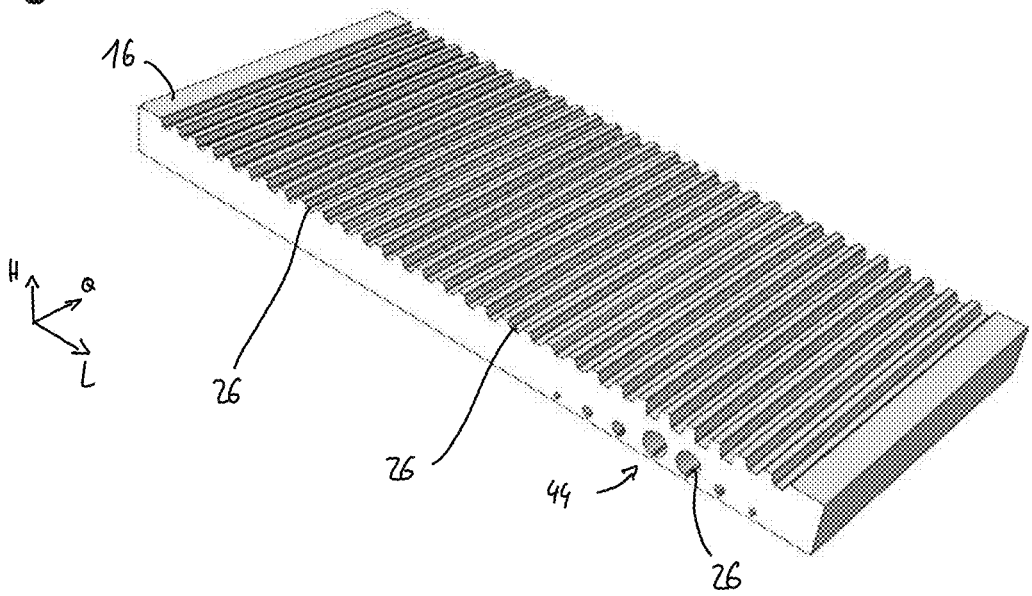
FIG. 2 shows a supporting layer of the foam core according to FIG. 1 in a perspective view.

In the transverse direction Q, for example, the foam core 14 is the same over the entire width thereof, as can be seen in FIG. 2.

In the longitudinal direction L, the upper part 20 has a plurality of different body support regions 24 which differ, in particular, in their strength to compression.

The body support regions 24 have different lengths in the longitudinal direction L.

In each of the body support regions 24, a plurality of recesses 26 are provided in the upper part and extend along the entire transverse direction Q.

In the first example embodiment, as can be readily seen in FIG. 2, the recesses 26 have a downwardly tapering trapezoidal profile extending from the upper side of the supporting layer 16.

The recesses 26 differ in their extent in the upward direction H, that is, in their depth.

In other words, the recesses 26 in the upper part 20 are a plurality of grooves of different depths extending across the entire width of the foam core 14.

The recesses 26 of the upper part 20 may of course also have other profiles, such as oval, circular, rectangular or diamond-shaped profiles.

In the shown example embodiment of FIG. 1, the upper part 20 includes six different body support regions 24.

Three of the body support regions 24 respectively lie on different sides of a center plane M which is perpendicular to the longitudinal direction L and divides the foam core 14 into two halves 28, 36 of equal length, i.e. halves 28, 36 which have the same extent in the longitudinal direction L.

The first half 28 thus has the body support regions 30, 32, 34 and the second half 36 has the body support regions 38, 40, 42.

The two body support regions 34, 38 of the halves 28, 36 are adjacent to the center plane M and are therefore referred to as central body support regions 34 and 38, respectively.

The body support regions 30, 42 of the halves 28, 36 are located at the respective ends of the foam core 14 in the longitudinal direction L and are therefore referred to as outer body support regions 30 and 42, respectively.

The body support regions 32 and 40 of the halves 28, 36 are respectively located between the central body support regions 34, 38 and the outer body support regions 30, 42 and are therefore referred to as center body support regions 32, 40.

For example, all of the body support regions 30-34, 38-42 are contiguous so that the entire length of the foam core 14 can be associated with each of the body support regions 30-34, 38-42.

For example, the outer body support regions 30, 42 each have a length corresponding to between 25% and 35%, in particular 28%, of the total length of the foam core 14 in the longitudinal direction L. The outer body support regions 30, 42 are thus the longest of the body support regions 30-34, 38-42.

In the example embodiment shown, the center body support regions 32, 40 are longer than the central body support regions 34, 38.

For example, the center body support regions 32, 40 have a length in the longitudinal direction L of between 10% and 14%, in particular of 12% of the total length of the foam core 14 in the longitudinal direction L.

The central body support regions 34, 38 may have a length in the longitudinal direction L of between 8% and 12%, in particular of 10% of the total length of the foam core 14 in the longitudinal direction L.

The recesses 26 reduce the volume of the body support regions 30-34, 38-42 compared to a supporting layer 16 made of a solid material.

For example, the reduction in volume in the outer body support region 30 of the first half 28 is between 1.5% and 2%, in particular 1.75% of the total volume of the foam core 14.

For the center body support regions 32, 40 of the first half 28 and the second half 36, respectively, the reductions are between 0.4% and 0.6%, in particular 0.5% of the total volume of the foam core 14.

For the central body support regions 34, 38 of the first half 28 and the second half 36, respectively, the reductions are each of between 0.45% and 0.55%, in particular equal to 0.5% of the total volume of the foam core 14.

For the outer body support region 42 of the second half 36, the reduction is between 1.3 and 1.7%, in particular between 1.35% and 1.65%, particularly preferably 1.5% of the total volume of the foam core 14.

With reference to a side or cross-sectional view, such as that shown in FIG. 3, the proportion of the areas of the recesses 26 of a particular body support region 24 to the total area of the respective body support region 24 is, for example, as follows.

Outer body support region 30 of the first half 28 between 10% and 13%, in particular equal to 11.6%.

Center body support region 32 of the first half 28 between 7% and 9%, in particular equal to 7.9%.

Central body support region 34 of the first half 28 between 4.5% and 6%, in particular equal to 5.4%.

Central body support region 38 of the second half 36 between 4.5% and 6%, in particular equal to 5.4%.

Center body support region 40 of the second half 36 between 4% and 5%, in particular equal to 4.4%.

Outer body support region 42 of the second half 36 between 4.5% and 5.5%, in particular equal to 5%.

The recesses 26 of the upper part 20 are thus asymmetrical with respect to the center plane M.

Due to the different numbers of recesses 26, the different geometries thereof, and the amount of material reduction, the body support regions 30-34, 38-42 have different strengths with respect to pressure from above, i.e., through the comfort layer 18.

For example, the outer body support regions 30, 42 have lower strengths than the respective central body support regions 34 and 38, respectively.

The center body support regions 32, 40 of each of the halves 28, 36 each have the greatest strength which is greater than the strength of the outer body support regions 30 of the respective half 28 or 36 as well as the respective central body support regions 34, 38 of the respective half 28 or 36.

For example, the central body support regions 34, 38 have the same strength.

A reserve region 44 extending in the longitudinal direction L is provided in the lower part 22 of the supporting layer 16.

Similar to the body support regions 30-34, 38-42, the reserve region 44 has recesses 26 extending in the transverse direction Q over the entire width of the foam core 14.

The reserve region 44 is formed in the first half 28, in particular exclusively in the first half 28.

The remaining part of the lower part 22 in the longitudinal direction L in particular does not have any recesses 26 and is thus made of solid material.

Therefore, the recesses 26 of the lower part 22 are also asymmetrical with respect to the center plane M.

Furthermore, the recesses 26 are exclusively located in the respective upper part 20 or lower part 22.

In the example embodiments shown, the reserve region 44 is for example located below the outer and the center body support regions 30, 32. The reserve region 44 thus has an extension in the longitudinal direction L of more than a quarter of the length of the foam core 14, in particular of 40% of the length of the foam core 14.

The recesses 26 in the reserve region 44 have a circular profile and have various circular diameters.

The recesses 26 in the reserve region 44 may of course also have an oval, a rectangular, a trapezoidal, a diamond-shaped profile, or a combination thereof.

Two large recesses 26 are for example provided which are surrounded on both sides in the longitudinal direction L by at least one, in particular at least two smaller recesses 26.

The reduction in volume due to the recesses 26 in the reserve region 44 is between 2.2% and 2.8%, in particular between 2.25% and 2.75%, particularly preferably 2.5% of the total volume of the foam core 14.

The proportion of the areas of the recesses 26 of the reserve region 44 to the total area of the reserve region 44 with respect to a side or cross-sectional view is, for example, between 11% and 14%, in particular 12.7%.

The recesses 26 in the reserve region 44 are substantially closed to the bottom side of the supporting layer 16, that is, only a small opening may be provided which is manufacturing-related. The appropriate cutting tool was for example inserted and extracted from the bottom side through this opening.

The reserve region 44 provides a reserve for the sinking in of the individual using the mattress, which however does not affect the strength of the overlying body support regions 30, 32 in every situation.

If the outer body support region 30 and/or the center body support region 32 of the first half 28, i.e. the upper part 20 above the reserve region 44 is loaded from above, which relates to the usual case of application of a sleeping person, two cases are now distinguished by the reserve region 44.

The two cases are delimited by a limit pressure for the load from above onto the upper part of the foam core. The limit pressure is predetermined by the design of the reserve region 44, and the limit pressure is for example between 4 kPa and 5 kPa, in particular 4.5 kPa.

If the load is below the limit pressure, the reserve region 44 is not substantially deformed and therefore does not contribute to the strength or supporting effect of the foam core 14, for example in comparison with a foam core 14 having a lower part 22 made of solid material, i.e. without any recesses 26.

In this case, the strength of the corresponding body support regions 30, 32 is exclusively defined by the recesses 26 of the body support regions 30, 32 themselves.

However, if the load exceeds the predetermined limit pressure, the reserve region 44 is thus also deformed, as a result of which the effective strength of the entire supporting layer 16 or of the foam core 14 in the region of the reserve region 44 changes. In other words, the foam core 14 in this region now has a different strength in comparison with a foam core 14 having no recesses 26 in the reserve region 44.

In this case, body parts of the person may sink to a greater extent such that the supporting effect is changed. The reserve region 44 thus provides a reserve for the sinking which however becomes active depending on the body type.

By means of the reserve region 44, it is possible that the mattress 10 is now optimally adapted both to back sleepers and to side sleepers having greatly differing body types, for example body types E and H and also body types I and A.

In particular, an optimization of a foam core or a mattress for back sleepers and simultaneously for side sleepers of body build types E or H was not possible so far without making any compromise as to the supporting effect.

For a side sleeper, the first half 28 is the head end and the second half 36 is the foot end, and for a back sleeper, the second half 36 is the head end and the first half 28 is the foot end. In other words, the mattress 10 or the foam core 14 has to be rotated about an axis in the upward direction H to provide optimum support of the vertebral column to either a side sleeper or a back sleeper.

For example, the recesses 26 in the outer body support region 42 of the second half are configured for an optimum sinking depth of the shoulder region of a back sleeper, the center body support region 40 of the second half 36 is optimally configured for the region of the lumbar vertebral column of a back sleeper, and the central body support region 38 of the second half 36 is optimally adapted to the hip.

It has been recognized that the body support regions 38, 40, 42 of the second half may be simultaneously optimized for the knee or foot region and the hip of a side sleeper.

In the first half 28, the reserve region 44 allows the optimization to both sleep types and also to the various previously discussed body types.

As in the second half 36, the central body support region 34 supports the buttocks and hip region of side and back sleepers in an optimum way.

The center body support region 32 of the first half 28 optimally supports the lumbar vertebral column for side sleepers, and the region of the knees for back sleepers.

Due to the different body types, it is however necessary to vary the strength or sinking depth at least in the outer body support region 30 of the first half 28 over a large area in which the shoulders are located.

For light body types such as body types I and A having a comparatively light shoulder area, the optimum sinking depth is achieved by the recesses 26 of the outer support region 30 of the first half 28 alone, as these body types generate a load below the limit pressure. The same applies to the feet of back sleepers (irrespective of the sleeping type). The support is thus relatively strong, i.e. the sinking depth is relatively low.

However, for individuals of body types E and H which are side sleepers, a greater sinking depth is required for the shoulders in the outer body support region 30 of the first half 28. However, the shoulders of these body types generate a load on the upper part 20 above the reserve region 44 which is above the limit pressure, such that the reserve region 44 is now also deformed and the strength of this region is reduced. The shoulders of the individuals of body types E and H therefore sink further and use at least part of the sinking reserve provided by the reserve region 44. An optimum lying position in the side sleeper position can thus also be achieved for these body types.

In summary, both back sleepers and side sleepers of each of the body types H, E, I, A obtain an optimum support of the vertebral column on the mattress 10.

Figure 4:
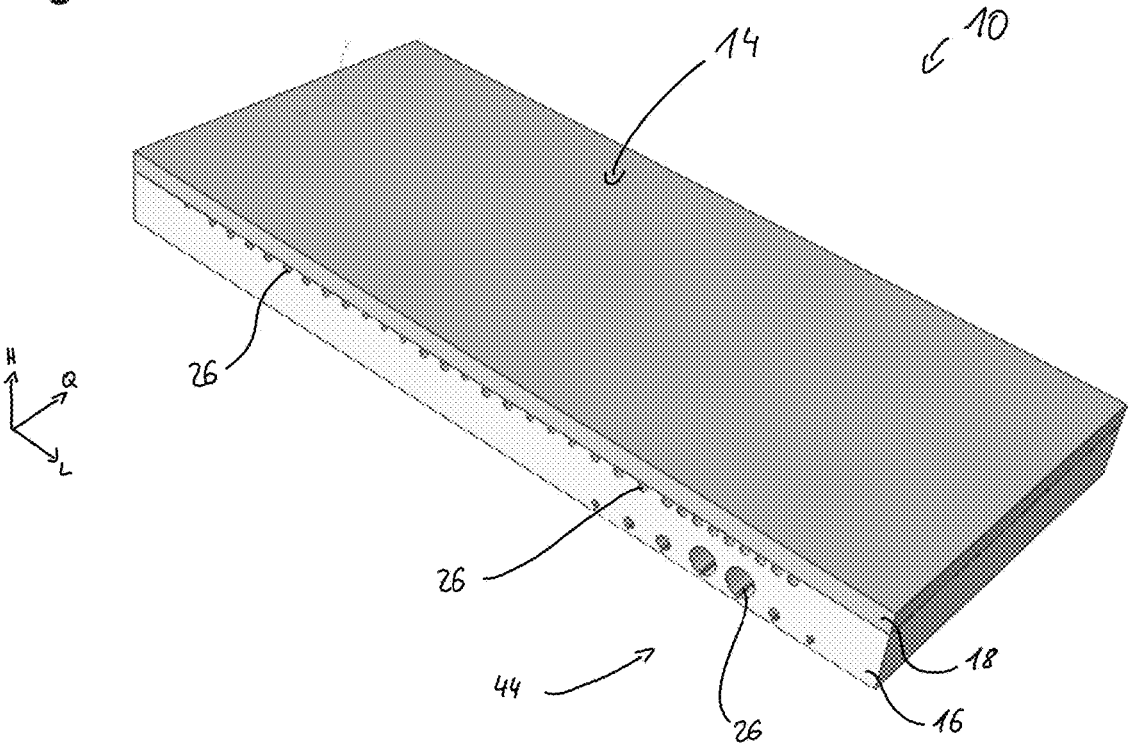
FIG. 4 shows a second embodiment of a mattress according to the present disclosure in a perspective view.
Figure 5:
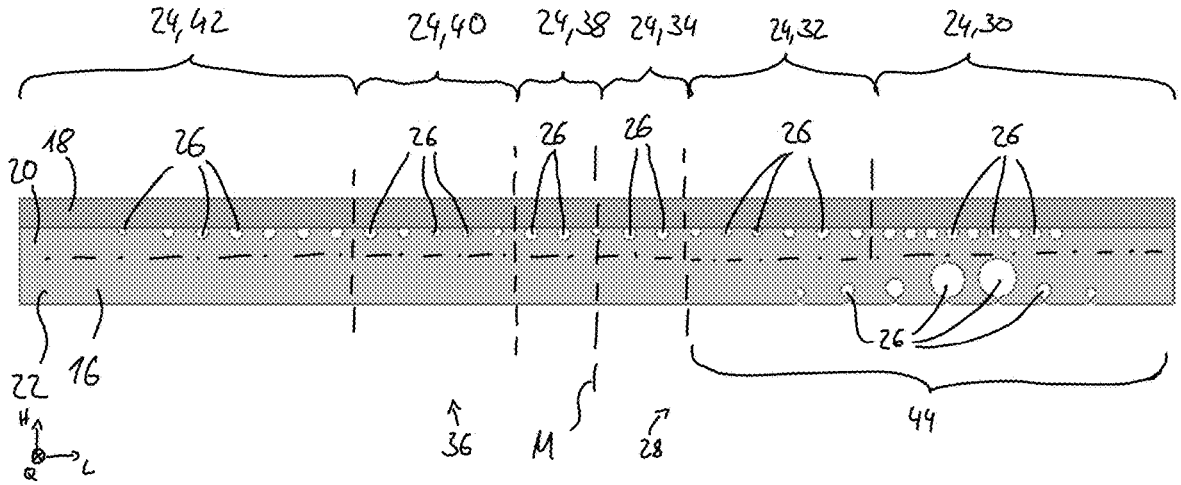
FIG. 5 shows a side view of the mattress according to FIG. 4.

FIGS. 4 and 5 show a second embodiment of the mattress 10 (representation without reference 12 for simplification) and of the foam core 14 which substantially correspond to the previously described embodiment. Merely the differences are thus explained below, and identical or functionally identical parts are provided with the same reference numerals.

In contrast to the first embodiment, the recesses 26 of the body support regions in the upper part 20 are configured so as to have a circular profile.

Due do the modified profile in comparison with the first embodiment, the ratios of the recesses 26 compared to the total volume of the foam core 14 or the surface of the respective body support region 24 are also different. The properties of the body support regions 24 are unchanged, in particular when compared with each other.

The invention claimed is:

1. A foam core for a mattress, comprising:

a supporting layer for supporting a vertebral column, the supporting layer including an upper part and a lower part, different body support regions being provided in the upper part along a longitudinal direction of the foam core, a plurality of the different body support regions having at least one first recess in a material of the foam core, at least one reserve region being provided in the lower part of the supporting layer along the longitudinal direction of the foam core and having a plurality of second recesses in the material of the foam core, wherein the plurality of second recesses in the reserve region have a circular profile and have various circular diameters, the plurality of second recesses including two larger recesses surrounded on both sides in the longitudinal direction by at least one smaller recess, wherein the foam core is formed such that the reserve region is not substantially deformed in case of a load on the upper part above the reserve region if the load is below a predetermined limit pressure, and that in case of a load above the predetermined limit pressure, the reserve region is deformed, wherein the at least one first recess and the plurality of second recesses run parallel to a transverse direction of the foam core and/or run over an entire width of the foam core, and wherein the at least one first recess of the different body support regions are exclusively located in the upper part.

2. The foam core according to claim 1, wherein the at least one first recess comprises several first recesses in the upper part that are grooves originating from an upper side of the foam core.

3. The foam core according to claim 2, wherein all of the at least one first recesses in the upper part are grooves originating from the upper side of the foam core.

4. The foam core according to claim 2, wherein the grooves partly have different depth in an upward direction.

5. The foam core according to claim 1, wherein the different body support regions have different strengths.

6. The foam core according to claim 1, wherein outer body support regions in the longitudinal directions have a lower strength than adjacent body support regions.

7. The foam core according to claim 1, wherein the foam core has a center plane perpendicular to the longitudinal direction which subdivides the foam core into a first half and a second half.

8. The foam core according to claim 7, wherein the at least one first recess and/or the plurality of second recesses are asymmetrical with respect to the center plane.

9. The foam core according to claim 7, wherein the at least one reserve region is provided exclusively in the first half.

10. The foam core according to claim 7, wherein the foam core is formed such that the first half as a head end and the second half as a foot end provide support of the vertebral column for side sleepers, and the first half as a foot end and the second half as a head end provide optimum support of the vertebral column for back sleepers.

11. The foam core according to claim 7, wherein a central body support region adjoining the center plane, a center body support region arranged between the central body support region and an outer body support region provided in each of the first and second halves, the outer body support regions adjoining respective ends in the longitudinal direction of the foam core.

12. The foam core according to claim 11, wherein the outer body support region respectively has a lower strength than the central body support region, and/or wherein the center body support region respectively has a higher strength than the outer body support region and the central body support region, and/or wherein the central body support region of the first half has a same strength as the central body support region of the second half.

13. The foam core according to claim 11, wherein the reserve region is provided below the outer body support region and/or below the center body support region of the first half.

14. The foam core according to claim 1, wherein the reserve region extends from one end of the foam core in the longitudinal direction.

15. The foam core according to claim 1, wherein the reserve region extends from one end of the foam core in the longitudinal direction further than a quarter of a length of the foam core.

16. The foam core according to claim 1, wherein the foam core has a comfort layer which is provided on an upper side of the supporting layer.

17. The foam core according to claim 16, wherein the comfort layer is free from recesses.

18. A mattress comprising the foam core according to claim 1.

19. A foam core for a mattress, comprising a supporting layer for supporting a vertebral column, the supporting layer including an upper part and a lower part, different body support regions being provided in the upper part along a longitudinal direction of the foam core, a plurality of the different body support regions having at least one first recess in a material of the foam core, at least one reserve region being provided in the lower part of the supporting layer along the longitudinal direction of the foam core and having a plurality of second recesses in the material of the foam core, wherein the plurality of second recesses in the reserve region have a circular profile and various circular diameters, the plurality of second recesses including two larger recesses surrounded on both sides in the longitudinal direction by at least one smaller recess, wherein the foam core is formed such that the reserve region is not substantially deformed in case of a load on the upper part above the reserve region if the load is below a predetermined limit pressure, and that in case of a load above the predetermined limit pressure, the reserve region is deformed, wherein the at least one first recess comprises several first recesses in the upper part that are grooves originating from an upper side of the foam core, and wherein the first recesses of the different body support regions are exclusively located in the upper part.

20. A foam core for a mattress, comprising a supporting layer for supporting a vertebral column, the supporting layer including an upper part and a lower part, different body support regions being provided in the upper part along a longitudinal direction of the foam core, a plurality of the different body support regions having at least one first recess in a material of the foam core, at least one reserve region being provided in the lower part of the supporting layer along the longitudinal direction of the foam core and having a plurality of second recesses in the material of the foam core, wherein the plurality of second recesses in the reserve region have a circular profile and various circular diameters, the plurality of second recesses including two larger recesses which are surrounded on both sides in the longitudinal direction by at least one smaller recess, wherein the foam core is formed such that the reserve region is not substantially deformed in case of a load on the upper part above the reserve region if the load is below a predetermined limit pressure, and that in case of a load above the predetermined limit pressure, the reserve region is deformed, wherein the limit pressure ranges from 4 to 5 kPa, and wherein the at least one first recess of the different body support regions are exclusively located in the upper part.

* * * * *